United States Patent [19]

Hervé

[11] Patent Number: 4,714,073

[45] Date of Patent: Dec. 22, 1987

[54] HEATING APPARATUS OPERATING WITH GASEOUS FUEL AND DESIGNED TO BE CONNECTED TO A SMOKE PIPE

[75] Inventor: Michel Hervé, Rosny sous Bois, France

[73] Assignee: S.A. Fonderies du Lion, Frasnes Lez Couvin, Belgium

[21] Appl. No.: 892,090

[22] Filed: Jul. 30, 1986

[51] Int. Cl.[4] ..... F24C 3/00

[52] U.S. Cl. ..... 126/91 R; 126/58; 126/75; 126/83; 126/85 R

[58] Field of Search ..... 126/58, 65, 75, 82, 126/83, 84, 85 R, 85 B, 90 R, 91 R, 116 B, 118; 237/70

[56] References Cited

U.S. PATENT DOCUMENTS 1,269,907 6/1918 Cole ..... 126/91 R
3,536,060 10/1970 Block et al. ..... 126/307 A
3,623,458 11/1971 Block ..... 126/85 R X
4,240,400 12/1980 Jenkins ..... 126/91 R

FOREIGN PATENT DOCUMENTS 1341253 9/1963 France ..... 126/91 R

*Primary Examiner*—Margaret A. Focarino
*Attorney, Agent, or Firm*—Karl F. Ross; Herbert Dubno; Ronald Lianides

[57] ABSTRACT

A discharge pipe is directly associated with one of the main heat exchange walls of a monoblock heating body, and a backflow damping device comprises two siphons placed symmetrically on either side of the pipe, each having a passage above the level of the horizontal axis of the pipe, which axis is situated in the median transverse plane of the heating body, and each of the siphons is situated substantially in line with an opening formed in the corresponding lateral side near the corresponding one of the two ends of the burner.

7 Claims, 7 Drawing Figures

HEATING APPARATUS OPERATING WITH GASEOUS FUEL AND DESIGNED TO BE CONNECTED TO A SMOKE PIPE

FIELD OF THE INVENTION

The present invention relates in a general manner to independent heating apparatus operating with gaseous fuel and designed to be connected to a suitable smoke pipe, the air for supporting combustion being taken from the surroundings in which the apparatus is installed. These apparatus are commonly known as chimney, wall or flat mounted heaters according to their method of installation.

BACKGROUND OF THE INVENTION

Such apparatus generally comprise a casing inside which is a combustion chamber, also known as a heating body, designed to accommodate in its lower part at least one burner in which the gas is ignited and control devices for the gas supply. The products of combustion pass through the heating body and heat exchange takes place with the surrounding air in contact with the walls of the heating body. The said products of combustion then pass through a box known as a flame damper generally situated at the back of the heating body and connected to the latter by one or more channels or collecting pipes. Such a box generally comprises a device for reducing the effect of the draught and if necessary preventing any deleterious influence of the backflow wind on the operation of the burner and on combustion. The box also contains a discharge pipe for productions of combustion designed to be connected to a suitable smoke pipe.

It will readily be seen that the manufacture of such a box with outflow parts and parts requiring to be connected to the back of the heating body is expensive.

Moreover, since this box adds to the depth of the heating body and is generally covered by the casing, the cost of the casing will increase according to the depth of the box. In addition. the box adds to the bulk and weight of the whole apparatus, which is reflected in the cost of packaging, storage and transport.

A box containing the damping devices and integrated in a heating body has been disclosed in U.S. Pat. No. 3 536 060. The said Patent, however, describes a boiler in which the effective heat exchange is obtained entirely from the heat exchange tubes in which a fluid exchange medium circulates. The walls of this box which carries the discharge pipe do not contribute to the useful thermal yield of the boiler, and the calorific wastage of the walls constitute a loss of effective yield.

OBJECT OF THE INVENTION

It is therefore an object of the present invention to provide an independent heating apparatus of the type defined above having a simple construction which lowers the cost of the finished product and the cost of packaging and transport.

SUMMARY OF THE INVENTION

An independent heating apparatus according to the invention operating with gaseous fuel and designed to be connected to a smoke pipe, of the type comprising a heating body designed to accommodate at least one burner, a damping device, devices for controlling the gas flow and auxiliary devices is characterised in that the discharge pipe is directly connected to one of the main active heat exchange walls of a monoblock heating body and in that the damping device comprises two siphons placed symmetrically on either side of the discharge pipe, each having a passage above the level of the horizontal axis of the pipe, which axis is situated in the medium transverse plane of the heating body and each of the siphons being situated substantially in alignment with an opening in the corresponding side wall and near the corresponding one of the two ends of the burner.

According to the invention, the heating body has a baffle plate situated above the burner and extending virtually along its whole length and embracing in its central part the opening of the horizontal discharge pipe and extending symmetrically on either side of this zone and having sloping flaps at each end vertically above lateral deflectors so as to form part of the siphons.

By a judicious combination of these various elements of such a heating body, the damping device is advantageously integrated therewith.

According to one preferred embodiment of the invention, the front surface, the rear surface, the upper surface and the lower surface of the heating body are all made in one piece and formed by folding up a single piece which forms the covering of the heating body which has a generally elongated, rectangular form.

In view of its simple, rectangular form, the heating body need not be covered with a casing to conceal it. Only the gas flow controls and auxiliary devices may be grouped separately inside a casing having the same profile as the heating body and placed at the end of the body as an extension thereof.

It will be seen that such a design of the apparatus has the advantage of considerably reducing the number of parts of which it is composed, compared with the usual designs,and that the operations required for assembly are also reduced since there is no box to be connected to the heating body, and all this is reflected in the cost of the finished product. Another advantage of the apparatus according to the present invention is that it is less bulky than a similar type of apparatus hitherto produced since the backflow damping device is integrated with the heating body. Since the bulk and weight are considerably reduced, there is a favourable reduction in the cost of packaging, storage and transport.

Moreover, owing to the simplicity of the parts and the small number of parts required, the outlay required for the tools and implements for their manufacture is greatly reduced and since the finished apparatus is very thin it can easily be accommodated in narrow rooms such as corridors and hallways.

BRIEF DESCRIPTION OF THE INVENTION

Further features and advantages of the invention will emerge from the detailed description given below by way of example with reference to the attached drawings, in which FIG. 1 is an elevational view in longitudinal section of an apparatus according to the invention taken on the line I—I of FIG. 2;

SPECIFIC DESCRIPTION

Figure 2:
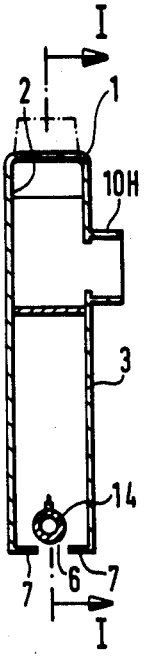
FIG. 2 is an elevational view in transverse section taken on the line II—II of FIG. 1.
Figure 1:
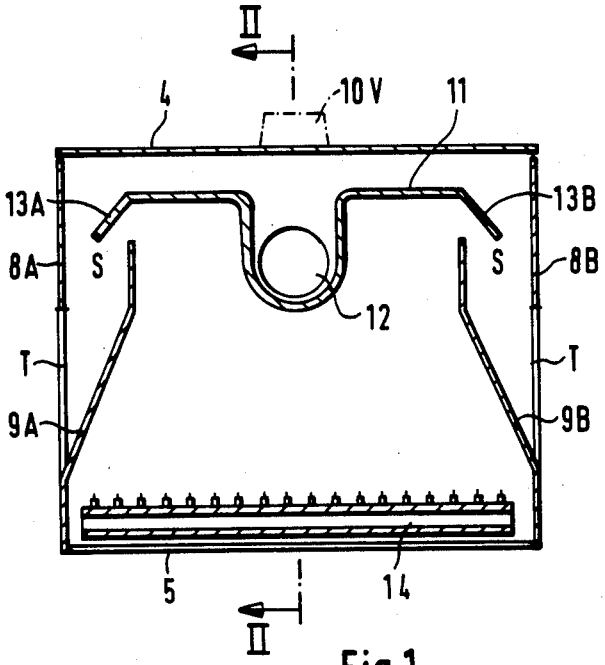

According to one embodiment of the invention represented in the Figures, an apparatus designed to be connected to a smoke pipe and operating on gaseous fuel essentially comprises a heating body containing the burner or burners.

The heating body according to the invention comprises a casing 1 which incorporates the exhaust discharge pipe 10H or 10V and in which each of the two lateral ends form the damping device by the combination of side walls 8A,8B, deflectors 9A,9B and central baffle 11.

The aforesaid casing 1 is formed by a front wall 2, a rear wall 3 carrying the discharge pipe 10H for horizontal connection, an upper wall 4 optionally carrying the discharge pipe 10V for vertical connection, and a lower wall 5 having a longitudinal opening 6 for the passage of air supporting combustion, which opening is formed by the gap left between the two folds 7 closing the casing.

The two lateral ends of this casing 1 are only partially closed in the upper part by a side wall 8A on one side and 8B on the other side and in the lower part by a sloping deflector 9A on one side and 9B on the other side, which deflectors partly extend into the interior of the casing 1.

Inside this casing 1. in its upper part, a central baffle plate 11 extends around the opening 12 of the discharge pipe 10H and extends symmetrically on either side thereof to a position must above the end of each lateral deflector 9A,9B to end in downwardly sloping flaps 13A,13B which form part of a sort of siphons on each side of the casing.

In the embodiment described above, the lateral deflectors 9A,9B and the central baffle 11 are integrally connected with the front wall/2 and rear wall 3 of the casing 1 as are also the side parts 8A,8B which in addition are integrally connected with the upper wall 4.

The heating body constituted as described above accommodates the burner 14 in its lower part and has a construction which is symmetrical on either side of a median transverse plane.

Figure 3:
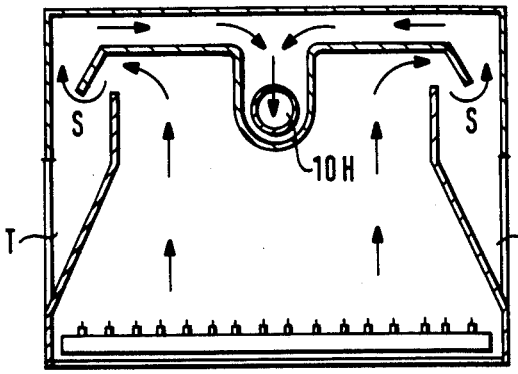
FIG. 3 illustrates schematically the mode of operation of the apparatus under the effect of a natural draught.

In such a heating body normally operating by natural draft (FIG. 3), the products of combustion are carried along two symmetric paths on either side of a median transverse plane to reach the discharge pipe 10H or 10V by way of the siphons S formed at the lateral sides. It will readily be seen that the damping function is obtained by each of the openings T left in the two side walls below each siphon S.

Figure 4:
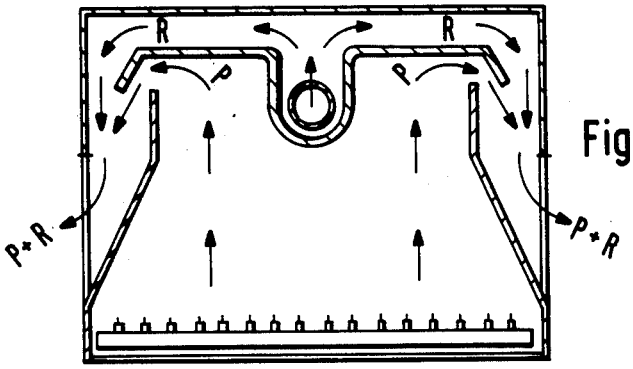
FIG. 4 illustrates schematically the operation of the damping device.

When the heating body is subjected to a backflow current (FIG. 4) from the smoke pipe to which the discharge pipe 10H or 10V is connected, this backflow current R is channelled symmetrically on either side of the discharge charge pipe to lateral openings T provided for the damping function and are then discharged through these openings together with the products of combustion P which are carried along at the exit from each siphon by the speed of this backflow current. The container or chamber in which the burner is situated is then under a slight vacuum which ensures that the operation of the burner and the process of combustion are not affected by this backflow.

Figure 5:
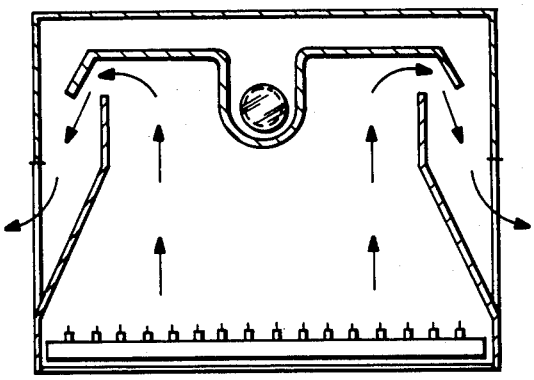
FIG. 5 illustrates schematically the operation of the apparatus with the smoke pipe closed.

It may also be noted that if the smoke pipe is closed (FIG. 5), the products of combustion are still evacuated under suitable conditions through the same lateral openings T.

This heating body may be fitted with a suitable casing which will obviously be reduced in depth since the damping device is integrated within the thickness of the heating body.

Figure 6:
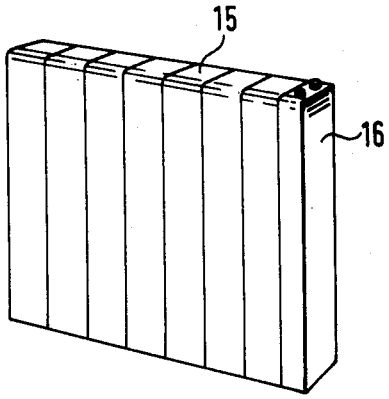
FIG. 6 is a view in perspective of the apparatus seen from the front, with the heating body extended in length by the casing containing the controls for the gas supply.
Figure 7:
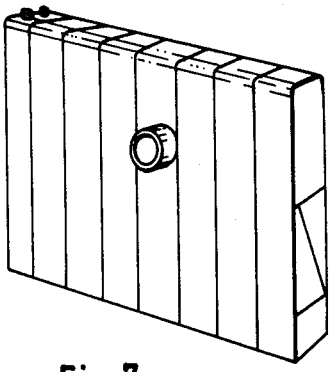
FIG. 7 is a view in perspective of the apparatus seen from the back.

According to one variation (FIGS. 6 and 7), the heating body is not necessarily enclosed in a housing. The casing 1 which constitutes the main part of the rectangular heating body 15 may be made of a ribbed sheet metal and extended by a housing 16 of the same profile containing the gas-flow control devices and auxiliary devices for operating the heater. This aesthetic embodiment of the invention greatly emphasizes the economic method of manufacture of the product.

It is to be understood that the invention is not confined to the embodiment defined above, the parts of which are generally obtained by folding and assembling by welding or soldering. The same principle may be adopted with a varying number of parts which may be formed by stamping or casting or by some other means and constitute the object of modifications without thereby departing from the scope of the present invention.

I claim:

1. Independent heating apparatus operating with gaseous fuels and designed to be connected by a discharge pipe to a smoke pipe, of the type comprising a heating body formed by a housing having a front wall, a rear wall, a pair of lateral end walls each provided with an opening, a top wall and a bottom wall equipped with an elongated burner disposed in a burner chamber in said housing, a backflow damping device in said housing and defining said chamber, and means for controlling both a gas flow to said burner and auxiliary apparatus for operation said heater, wherein said discharge pipe is horizontally mounted on one of said walls of said heating body and said damping device comprises two siphons disposed symmetrically on either side of said discharge pipe, each siphon forming a passage between said chamber and said discharge pipe and the respective opening associated with the respective siphon above the level of a horizontal axis of said pipe, said axis being disposed in a median transverse plane of said heating body and each of said siphons being disposed substantially in line with the respective opening formed in the corresponding lateral end wall, each opening being disposed near a respective end of said elongated burner.

2. Apparatus according to claim 1, wherein said damping device further comprises a baffle disposed above said burner and extending substantially over the whole thereof and embracing in a central zone thereof said opening of said horizontal discharge pipe and extending symmetrically on either side of said zone and ending in downwardly sloping flaps disposed above lateral deflectors and forming part of the siphons therewith.

3. Apparatus according to claim 1, wherein said front wall, said rear wall, said upper wall and said lower wall are unitary and are folded to form said housing of said heating body which has a generally rectangular, elongated form.

4. Apparatus according to claim 1, wherein said smoke discharge pipe is mounted horizontally on said rear wall of said heating body.

5. Apparatus according to claim 1, wherein said heating body is extended laterally at one end by a casing having the same profile as said heating body and containing said means for controlling the gas flow and auxiliary devices for operating said heater.

6. Apparatus according to claim 1, wherein said housing and said damping device are made of folded sheet metal.

7. A gas-fueled heating apparatus comprising:

a heating body formed by a housing having an upright front wall and an upright rear wall interconnected by a pair of upright lateral endwalls, said front and rear walls and said pair of endwalls being further interconnected by a top wall and a bottom wall;

a discharge outlet formed in one of said upright walls of said housing and having a horizontal axis;

a lateral opening formed in at least one of said endwalls at a level below said discharge outlet;

a backflow damping device formed in said housing and defining a chamber;

a burner disposed in said chamber at a level below said lateral opening;

at least one draft passage formed in said chamber at a level above said horizontal axis and communicating with said discharge outlet and said lateral opening;

an air inlet formed in said bottom wall and communicating with said chamber; and means for controlling a flow of gas to said burner;

said backflow dampening device comprising at least one deflector plate juxtaposed with said lateral opening and diverging upwardly from the endwall thereof to an edge at a level above said horizontal axis, and a baffle plate embracing said discharge outlet and having a flap overlaying said edge and sloping downwardly to substantially the same level as said edge and forming therewith said draft passage.

* * * * *